US006485069B1

(12) United States Patent
Anderson

(10) Patent No.: US 6,485,069 B1
(45) Date of Patent: Nov. 26, 2002

(54) DOOR LATCH ASSEMBLY

(76) Inventor: Lawrence E. Anderson, 6500 Elm St., Hamel, MN (US) 55340

( * ) Notice: Subject to any disclaimer, the term of this patent is extended or adjusted under 35 U.S.C. 154(b) by 0 days.

(21) Appl. No.: 09/536,464

(22) Filed: Mar. 28, 2000

(51) Int. Cl.[7] ..... E05C 1/10
(52) U.S. Cl. ..... 292/175; 292/DIG. 63
(58) Field of Search ..... 292/163, 164, 292/166, 175, 169, 337, DIG. 63

(56) References Cited

U.S. PATENT DOCUMENTS

| | | | | | |
|---|---|---|---|---|---|
| 357,116 | A | | 2/1887 | Coultaus | |
| 893,072 | A | | 7/1908 | Hayes | |
| 1,185,217 | A | | 5/1916 | Lilly | |
| 2,007,854 | A | | 7/1935 | Grill | |
| 2,497,624 | A | | 2/1950 | Nelson | |
| 2,516,527 | A | | 7/1950 | Oltz | |
| 2,759,752 | A | | 8/1956 | Demings | |
| 3,125,366 | A | | 3/1964 | Cetrone et al. | |
| 3,552,158 | A | | 1/1971 | Lengen | |
| 3,909,051 | A | | 9/1975 | Nakai | |
| 4,109,948 | A | * | 8/1978 | Potter et al. | 292/169.15 |
| 4,113,292 | A | | 9/1978 | Gauron et al. | |
| 4,525,004 | A | * | 6/1985 | Tanaka | 292/171 |
| 4,750,766 | A | * | 6/1988 | Shen | 292/337 |
| 4,927,195 | A | * | 5/1990 | Wu et al. | 292/169.14 |
| 5,074,605 | A | * | 12/1991 | Fann et al. | 292/337 |
| 5,169,184 | A | * | 12/1992 | Bishop | 292/1.5 |
| 5,490,695 | A | * | 2/1996 | Shiue | 292/1.5 |
| 6,030,008 | A | * | 2/2000 | Chang | 292/1.5 |
| 6,155,615 | A | * | 12/2000 | Schulz | 292/163 |

* cited by examiner

*Primary Examiner*—Jack Lavinder
*Assistant Examiner*—Devon Kramer
(74) *Attorney, Agent, or Firm*—Glen E. Schumann

(57) ABSTRACT

The present invention is a two piece plastic door latch for use with hinged doors. The invention is intended as a temporary replacement of a traditional doorknob system, and is specifically designed for use during construction of a building. A typical door includes a cutout for mounting the door knob assembly and a bore extending from the front edge of the door to the cutout, through which passes the door latch bolt. The invention consists of a tubular casing with a latch plate formed at one end and a latch bolt slidably mounted within a glide path formed within the casing. The casing is inserted into the bore and secured to the edge of a door by the latch plate. The latch bolt extends outwardly from the casing to engage a strike plate secured to the doorjamb. A rubber band secured to the casing engages the latch bolt to urge the latch bolt to its extended position, with the head of the latch bolt extending outward of the door edge. At the inward facing end of the latch bolt forms an "O" ring that is generally aligned with the cutout. The cutout provides access to the "O" ring. To open the door latch, an individual reaches through the cutout and grasps the "O" ring and slidably retracts the latch bolt back into the casing, allowing the door be opened.

1 Claim, 3 Drawing Sheets

DOOR LATCH ASSEMBLY

RELATED APLICATIONS

NOT APPLICABLE

FEDERALLY SPONSORED RESEARCH AND DEVELOPMENT

NOT APPLICABLE

MICROFICHE APPENDIX

NOT APPLICABLE

BACKGROUND OF THE INVENTION

The typical door knob assembly consists of opposing doorknobs secured to the edge of a door through a cutout in the door. A bore is drilled from the front edge of the door to the cutout, and defines a path along which the door latch bolt travels. While use of these standard doorknobs is convenient in a finished building, such devices create issues when the building is under construction.

During construction, many contractors need to access the building site. When a door is first installed, it is installed without the door locks. The door locks are usually installed as part of the finish work. Since no door latch exists, the doors are allowed to freely swing in the wind. This frequently results in damage to the door, doorjamb and wall surfaces that the door may strike.

There are a number of options utilized for reducing or eliminating the damage potentially caused by such unsecured doors. One option is for a builder to shim the door shut or nail studs across the door to prevent the door from swinging open. This is inconvenient as the contractors accessing the premises must remove the shims or studs each time they access the premises, and the shims and/or studs must be re-attached when the contractor leaves. Such constant shimming or securing of the door can also result in damage to the door system and walls. With the confusion of many contractors on site at the same time, the door is frequently left unsecured when everyone has left the premises, leaving the door system and walls vulnerable to damage.

Another option is to install traditional doorknobs on a temporary basis. This is both inconvenient for the builder and expensive. Because the doors must remain unlocked to permit access to the premises by all contractors working in the building, the locks can be removed. Additionally, if the wind should catch the door and the door swings hard against a finished wall, the knobs tend to damage the walls, unless door stops are also installed. Additionally, sometimes contractors lock the outside door, which renders it impossible for the next contractor arriving at the premises without a key to obtain access to the building.

A further problem with installing temporary doorknobs during construction arises when the door is being painted. When painted, the doorknobs must be removed for the door to be properly painted, which again allows the door to swing freely, now with wet paint. In addition to the potential damage to the door and walls, the quality of the paint job is jeopardized.

BRIEF SUMMARY OF THE INVENTION

The present door latch assembly is of two piece, plastic construction secured together with a common rubber band and is designed to be internally mounted within the bore and cutout of a standard hinged door. The door latch includes a one piece, plastic tubular casing with a latch plate formed at one end. The casing defines an internal guide path for receipt and movement of a latch bolt. A latch bolt is slidably mounted in the tubular casing with sufficient travel to protrude therefrom for latching engagement with an associated striker plate attached to the door jamb. An "O" ring is formed at the inward facing end of the latch bolt, which is accessible through the door cutout, so that the door latch may be retracted into the casing by digital movement of the "O" ring. The rubber band is attached to the casing and latch bolt to bias the latch bolt in a position causing part of the latch bolt to protrude from the casing for latching, yet allows manual retraction of the latch bolt within the casing.

One object of the invention is to provide an inexpensive plastic lock which is simple to install and remove, yet is durable and reliable when used in new construction.

Another object of the invention is to minimize the vulnerability of the door and structure to damage if the door should swing free.

Yet another object of the invention is to allow the door to be painted, without loss of the ability to secure the door in closed position.

Yet another object of the invention is to create a door latch which is easy to use by contractors who need to bring bulky or heavy product through the doorway.

Still another object of the invention is to provide a lock mechanism constructed primarily of molded plastic resin material, with a minimum number of parts for easy assembly, installation, use and removable.

With these and other objects in view, the invention consists of the construction, arrangement and combination of the various parts of the lock mechanism in a manner intended to attain the objects contemplated herein.

DETAILED DESCRIPTION OF THE INVENTION

Figure 1:
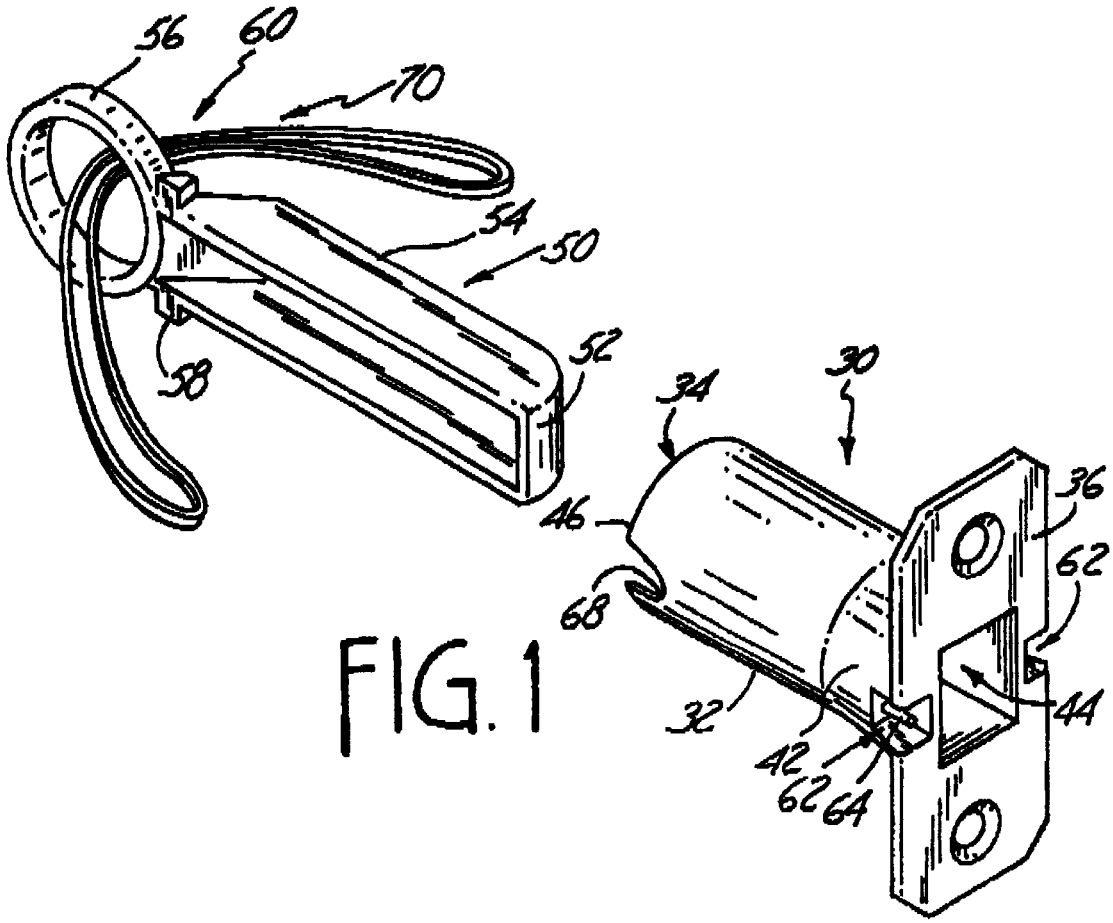
FIG. 1 is an exploded perspective view of all the individual parts of the door latch assembly.
Figure 2:
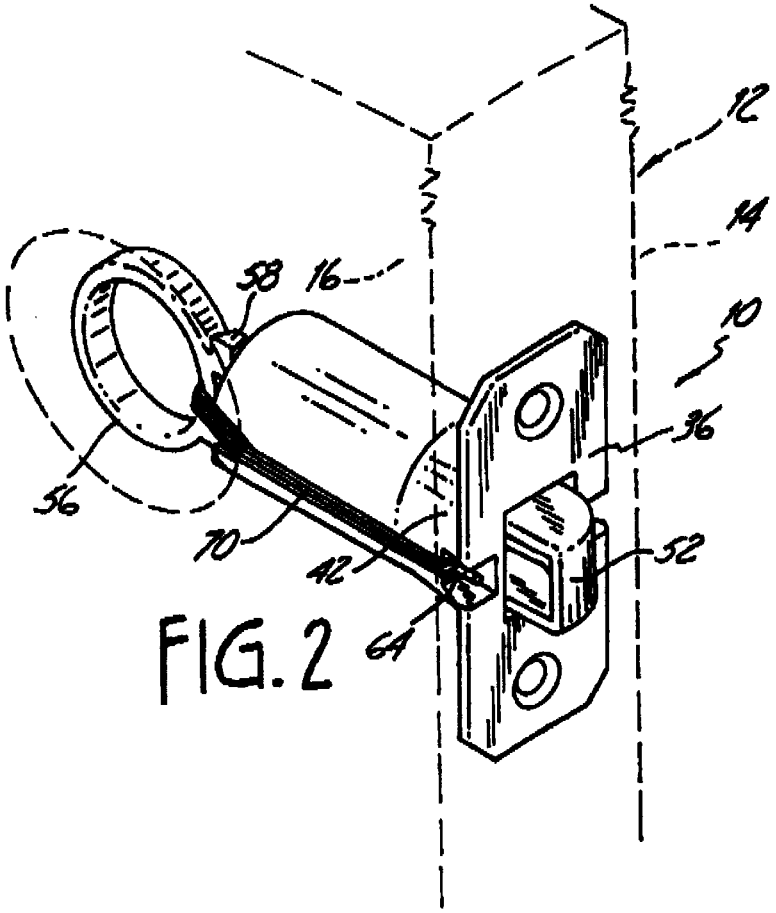
FIG. 2 is a perspective view of the door latch assembly as it would be installed on the leading edge of a hinged door.
Figure 3:
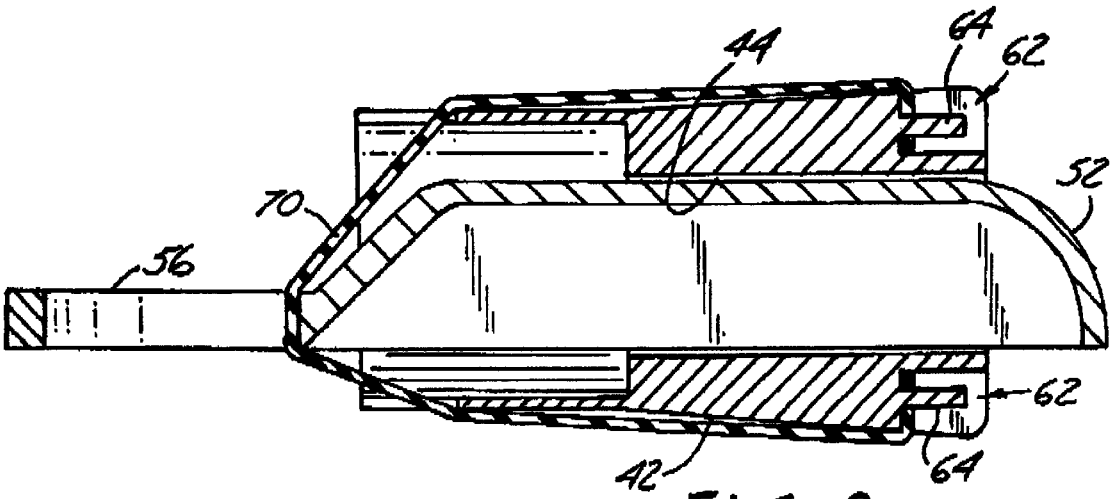
FIG. 3 is a cross sectional view along the longitudinal axis of the door latch assembly shown in FIG. 2.
Figure 4:
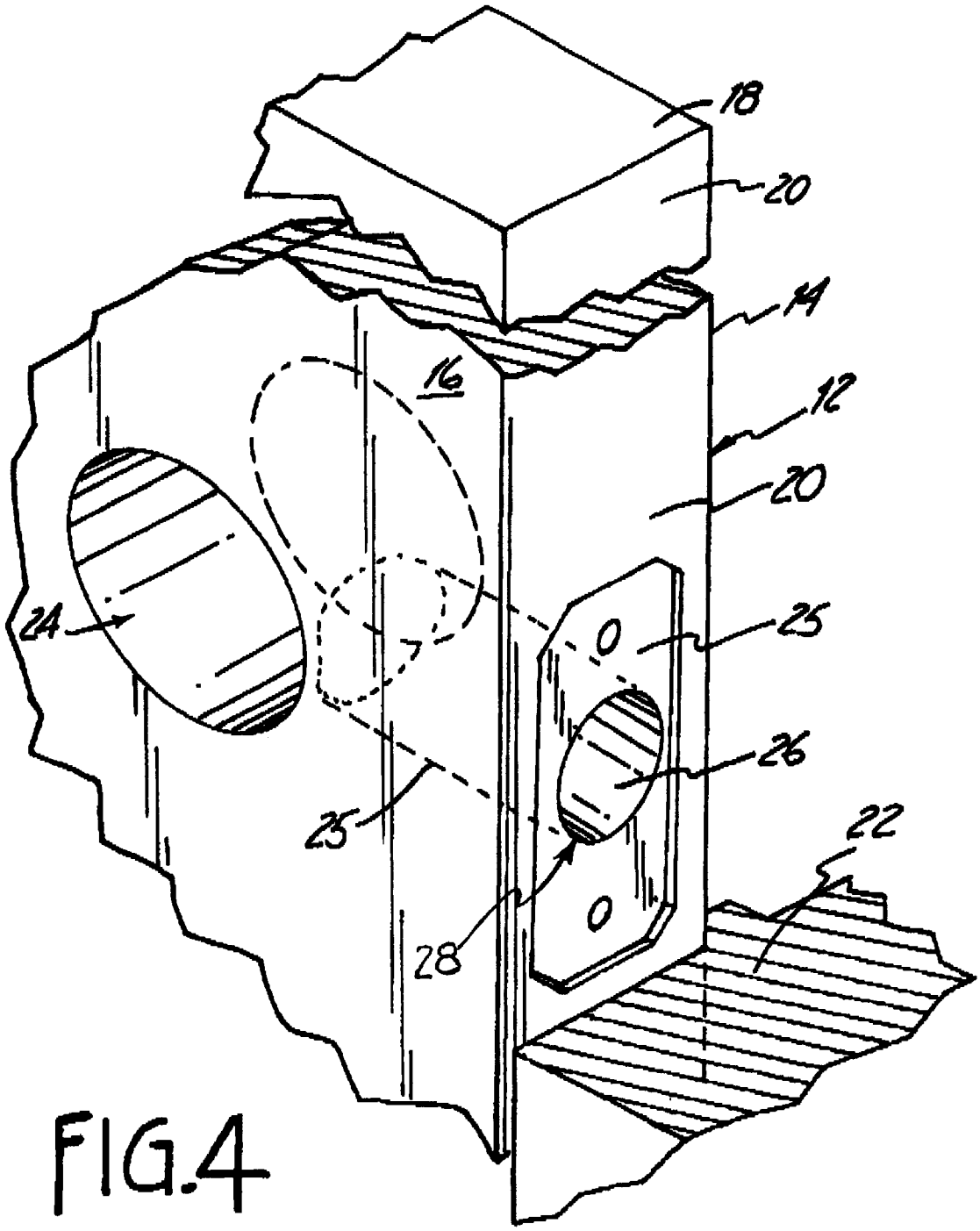
FIG. 4 is perspective view of a door illustrating the cutout and bore in which the door latch assembly is mounted and operable.

In a preferred embodiment of the invention shown in FIG. 2, a door latch assembly 10 is shown installed on a typical hinged door 12. The door includes two opposing faces, an inside face 14 and an outside face 16. The width of the door 12 between the inside face 14 and outside face 16 defines four additional perimeter surfaces or edges of the door 12, including a top edge 18 and a bottom horizontally opposed edge (not shown), and two vertically opposed sides or edges, a free or front edge 20 and a hinged edge (not shown). The hinged edge is secured to a doorjamb to create an axis about which the door swings. The free or front edge 20 houses the door latch assembly 10 for engagement with an appropriately aligned striker plate secured to the door jamb 22 as suggested in FIG. 4. A typical doorknob assembly is mounted to the door 12 through a circular cutout 24 in door 12. The doorknob assembly is connected to a latch bolt slidably extending through another cutout, bore 26, running from the front edge 20 of door 12 to the circular cutout 24.

The present invention, door latch assembly 10, includes a molded plastic casing 30, a molded plastic latch bolt 50 and a spring or rubber band 70. The casing 30 includes a generally tubular section 32, open at end 34, and an attachment plate 36 formed at an opposite end. The tubular section 32 of casing 30 is designed to be inserted in bore 26, with the casing 30 secured to the front edge 20 of door 12 by the attachment plate 36. The latch bolt 50 is designed to be slidably mounted within the casing 30. The rubber band 70 is secured to the casing 30 and engages the latch bolt 50 to bias the latch bolt 30 in an extended position, so that the head 52 of the latch bolt 50 protrudes outward from the front edge 20 of door 12, to engage a striker plate in doorjamb 22.

The door latch assembly 10 is designed to be mounted within the cutouts normally made in a door to accommodate a typical door knob system. A typical doorknob system requires that a door include a circular cutout 24 and bore 26. Additionally, the front edge 20 of door 12 is normally routered to create a recess for the attachment plate 36, so that the attachment plate 36 is flush mounted with the front edge 20 of door 12. Casing 30 is dimensioned to fit within the bore 26 with the open end 34 positioned in alignment with circular cutout 24.

The tubular section 32 of casing 12 is tapered inwardly from the attachment plate 36. This ensures that casing 30 can easily be inserted into bore 26, but will have a snug fit when the tapered wall 42 engages the inner wall of bore 26 upon securing attachment plate 36 to the front edge 20 of door 12. The attachment plate 36 is of typical design for attachment by two screws to the front edge 20 of door 12 over the opening end 28 of bore 26 within the defined recess.

The inside wall of tubular casing 30 defines a glide path 44 through which the latch bolt 50 retractably extends. The cross-sectional shape of the slot and latch bolt 50 are designed to hold the door latch head 52 in proper alignment for engagement with the door striker plate.

The latch bolt 50 includes an elongated shaft 54. At the front end of the shaft is formed a standard curved head 52 for engaging the striker plate. At the tail end of the shaft 54 is formed an "O" ring 56 of sufficient diameter to insert a human finger, yet small enough to slide through bore 26. Also formed at the tail end 60 of latch bolt 50 are two opposing protrusions or stops 58. These small protrusions engage the tail edge 46 of the tubular casing 30 to prevent the latch bolt head 52 from extending too far beyond the face of the attachment plate 36, although in the absence of such stops, the 'O' ring 56 would perform the same function.

On each side of the attachment plate 36, aligned with the longitudinal axis of the casing 30, exists a small recess 62 with a slight prong 64 projecting towards, but not significantly beyond, the front of the attachment plate 36. Also aligned with the longitudinal axis of the casing 30 but at its open end 34, exist grooves 68 in the wall of the tubular casing 32. When the latch bolt 50 is slidably mounted within casing 30, an elastic member, such as a spring or rubber band 70, is attached at one end to one of the prongs 64. The rubber band 70 is then stretched and guided to the same side groove 68, through the "O" ring 56, through the opposite groove 68 and connected to the opposite side prong 64. The elastic member 70 continually biases the latch bolt in an extended or engagement position, with the head 52 of the latch bolt 50 protruding from the front of the casing attachment plate 36.

When the door latch assembly 10 is attached to door 12, the "O" ring 56 is aligned with the circular cutout 24. Because the latch bolt 50 is biased to extend outward from the attachment plate, when the door 12 is swung shut, the door latch assembly 10 will always engage a striker plate mounted in alignment to the doorjamb 22, securing the door 12 in closed position. To open the door, a person simply reaches into the cutout 24, digitally grasps the "O" ring 56 and slides the latch bolt 50 back, disengaging the latch bolt head 52 from the striker plate, allowing the door 12 to be opened.

In operation, the door latch assembly presents numerous advantages over the existing art. The door latch assembly 10 is relatively inexpensive to make, is easy to assemble and install, and is very durable. There are few working parts to break. No modification of the door 12 is required to attach or operate the door latch assembly 10. The door latch assembly 10 is an internal mount, thus, if the door 12 should swing open and strike a wall, the damage typically occurring with doorknobs is obviated. The surface of the door may be readily painted without the need to remove the door latch assembly, allowing the door to remain in closed position. The time consuming and sometimes destructive method of shimming a door closed, or securing it in closed position with boards nailed across the doorjamb, is eliminated.

Having described the invention, I claim:

1. A door latch assembly including a latch bolt, internally mountable within a door having an outer edge through which the latch bolt can be extended and an adjacent cutout in which the latch assembly is mounted, comprising:

i) a generally tubular casing having an inner and outer surface, a longitudinal axis, open on one longitudinal end and on the opposite longitudinal end is formed an attachment plate, the attachment plate further defining lateral recessed prongs aligned with the longitudinal axis of the casing, the casing further having grooves defined on its open end, which grooves are aligned with the longitudinal axis of the casing and the recessed prongs, the inner surface of the casing defining a guide bore for receipt and movement of a latch bolt therein;

ii) a latch bolt of single piece construction, with a latch head formed at one end and a grasp formed at the other end, the latch bolt being slidably mounted through the open end of the tubular casing with sufficient travel for the latch head to be moved to an extended position, with the latch head protruding through the attachment plate for latching engagement with an associated striker plate, the grasp being accessible through the door cutout for manually retracting the latch bolt into the casing;

iii) and elastic means attached to the recessed prongs, and extending around the casing, through the grooves into engagement with the grasp end of the latch bolt to bias the latch bolt into its extended position, yet permitting manual retraction of the latch bolt within the casing.

* * * * *